US007909187B2

(12) United States Patent
Montgomery

(10) Patent No.: US 7,909,187 B2
(45) Date of Patent: Mar. 22, 2011

(54) MODULAR BABY BOTTLE SYSTEM

(76) Inventor: Lonzell Montgomery, New York, NY (US)

( * ) Notice: Subject to any disclaimer, the term of this patent is extended or adjusted under 35 U.S.C. 154(b) by 1066 days.

(21) Appl. No.: 11/707,980

(22) Filed: Feb. 20, 2007

(65) Prior Publication Data

US 2008/0197097 A1 Aug. 21, 2008

(51) Int. Cl.
*A61J 9/02* (2006.01)

(52) U.S. Cl. ..... 215/11.1; 215/11.2; 215/11.3; 215/11.6

(58) Field of Classification Search ..... 215/6, 11.2, 215/2, 11.1, 11.3, 11.6; 318/114; 700/94
See application file for complete search history.

(56) References Cited

U.S. PATENT DOCUMENTS 3,125,984 A * 3/1964 Okuyama ..... 116/217
3,258,873 A * 7/1966 Franco ..... 446/81
4,600,111 A * 7/1986 Brown ..... 215/6
4,898,060 A * 2/1990 To ..... 84/95.2
5,211,299 A * 5/1993 Manfredonia ..... 215/11.1
5,312,282 A * 5/1994 Cooper ..... 446/27
5,606,143 A * 2/1997 Young ..... 84/600
5,842,901 A * 12/1998 Montgomery ..... 446/77
6,186,637 B1 * 2/2001 Murrietta ..... 362/101
6,406,348 B1 * 6/2002 Pearce ..... 446/81
6,443,800 B1 * 9/2002 Rice ..... 446/227
6,652,346 B1 * 11/2003 Arnold, III ..... 446/81
7,607,629 B1 * 10/2009 Carrasco et al. ..... 248/346.07

FOREIGN PATENT DOCUMENTS

EP 1568343 A1 * 8/2005

* cited by examiner

*Primary Examiner* — Sue A Weaver
(74) *Attorney, Agent, or Firm* — H. Jay Spiegel

(57) ABSTRACT

A baby bottle has elongated threads at an upper portion designed to render the bottle compatible with a sub-system with the ability to reduce the incidences of bubbling within the baby formula. The bottle also includes a chamber in its bottom portion, sized and configured to removably receive a pacifier. In a further aspect, the chamber may be enclosed by a dummy cap. Alternatively, the chamber may be closed by a device comprising a combined program player and vibration source. A sleeve made of an elastic material can be stretched over the baby bottle to serve as an insulating cover. The sleeve may also include a pocket to contain the music and vibratory playing device. A heat sensor may be incorporated into the baby bottle so that the user may see a visual display of the temperature before providing the bottle to a baby.

7 Claims, 3 Drawing Sheets

MODULAR BABY BOTTLE SYSTEM

BACKGROUND OF THE INVENTION

The present invention relates to a modular baby bottle system. Baby bottles of a variety of types and designs are actively sold in the marketplace. A large variety of baby bottle designs address a similar variety of problems with their respective solutions.

Some baby bottle designs include liners to ensure sterility so that the user is not required to sterilize the baby bottle itself. They merely need to install a sterile liner within the baby bottle container. Other baby bottle designs are intended to preclude creation of bubbles within the liquid formula contained therein. Elimination of bubbles reduces the necessity to burp a baby.

It would be useful if a single baby bottle were devised that could accommodate to the sub-systems of a variety of manufacturers such as those who sell liners as well as devices to reduce the incidences of bubbling within the baby formula.

In another aspect, a need has developed for a baby bottle which is entertaining and stimulating for a baby. In this regard, Applicant is the patentee of U.S. Pat. No. 5,842,901, issued Dec. 1, 1998, for a baby bottle with musical and vibratory adapters. In Applicant's prior U.S. Patent, adapters are selectively installed on a baby bottle to provide music, vibration, or both. This product is effective in soothing and entertaining a baby using it. However, a need has developed for greater versatility, both in the vibratory aspect and the musical aspect.

Finally, it would be advantageous if an insulative sleeve could be made that would be adapted to slide over the outer surfaces of a baby bottle and include the provision of gripping means as well as means for holding in place a musical/vibratory device for the purposes set forth in Applicant's prior Patent.

It is with all of these needs in mind that the present invention was developed.

SUMMARY OF THE INVENTION

The present invention relates to a modular baby bottle system. The present invention includes the following interrelated objects, aspects and features:

(1) In a first aspect, the present invention contemplates a baby bottle having features facilitating its use with a number of different types of baby bottle accessories.

(2) In a further aspect, one such accessory is a liner system commonly sold in the marketplace by vendors including PLAYTEX. Such a liner is insertable within a baby bottle to ensure sterility of baby formula placed therein so that the user is not required to sterilize the baby bottle itself. The inventive bottle includes features making the baby bottle compatible with a liner such as is described above.

(3) In a further aspect, the inventive bottle is specifically designed with elongated threads at an upper portion thereof surrounding the upper opening. These elongated threads are specifically designed to render the bottle compatible with features such as a system commonly sold by a purveyor known as Dr. Brown which includes the ability to reduce the incidences of bubbling within the baby formula. That system includes a screw-on lid which has elongated threads to clamp in place the anti-bubbling sub-system. The inventive bottle includes the elongated threads to render it compatible with such a system.

(4) In a further aspect, the inventive bottle includes a chamber in its bottom portion, sized and configured to removably receive a pacifier. The pacifier may be stored within the chamber and may be removed when it is desired to use it. In one aspect, the chamber may be enclosed by a dummy cap or cover. In another aspect, the chamber may be closed by a device or cover comprising a combined music player and vibration source.

(5) The combined music player and vibration source device combines the vibrator and music box of Applicant's prior U.S. Pat. No. 5,842,901. However, additional features are provided. Concerning the vibration source, the present invention includes means permitting control of the amplitude and frequency of the vibrations as well as their pattern of operation. For example, with the amplitude and frequency pre-set, a pattern may be pre-programmed to cause the vibratory feature to activate for a period of 30 seconds, deactivate for a period of 20 seconds, re-activate for a period of 30 seconds, etc.

(6) The music playing portion of the inventive device may, if desired, include a port allowing music to be downloaded into a memory included in the device so that desired music may be re-played as desired. Additionally, the port can be used to download into the device pre-recorded programming including, for example, the voice of the mother of the baby saying things that would be soothing to the baby. Such sounds may be programmed to repeat over and over again to keep the baby calm and content.

(7) A sleeve may be provided made of an elastic material that may be stretched over the baby bottle to serve as an insulating cover. The sleeve may include handles allowing the baby bottle within the sleeve to be easily gripped. The sleeve may also include a pocket to contain the music and vibratory playing device. Alternatively, the sleeve may include a threaded coupling at the end remote from its opening to which the music player and vibration source device may be releasably attached.

(8) In an additional feature, a heat sensor may be incorporated into the baby bottle so that the user may see a visual display of the temperature before providing the bottle to a baby. The heat sensor and display may include an analog or digital temperature display or a chemical type display in which different colors are representative of a variety of temperatures.

Accordingly, it is a first object of the present invention to provide a modular baby bottle system.

It is a further object of the present invention to provide such a system in which a bottle includes features allowing it to be adapted to a variety of sub-systems now sold in the marketplace.

It is a yet further object of the present invention to provide such a device in which a sub-chamber is provided facilitating storage of a pacifier.

It is a still further object of the present invention to provide such a device in which a coupling is provided to allow releasable attachment of a music playing and vibration producing device.

It is a still further object of the present invention to provide such a device in which desired music or a desired voice program may be downloaded into the music playing device for controllable replay.

It is a still further object of the present invention to provide such a device in which the amplitude, frequency and pattern of playing of the vibration producing device may be adjustably controlled.

It is a still further object of the present invention to provide such a device in which an insulative sleeve may be stretched over the bottle.

It is a still further object of the present invention to provide such a device and system including a heat sensor and display so that display of the temperature of baby formula within the bottle may be known.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
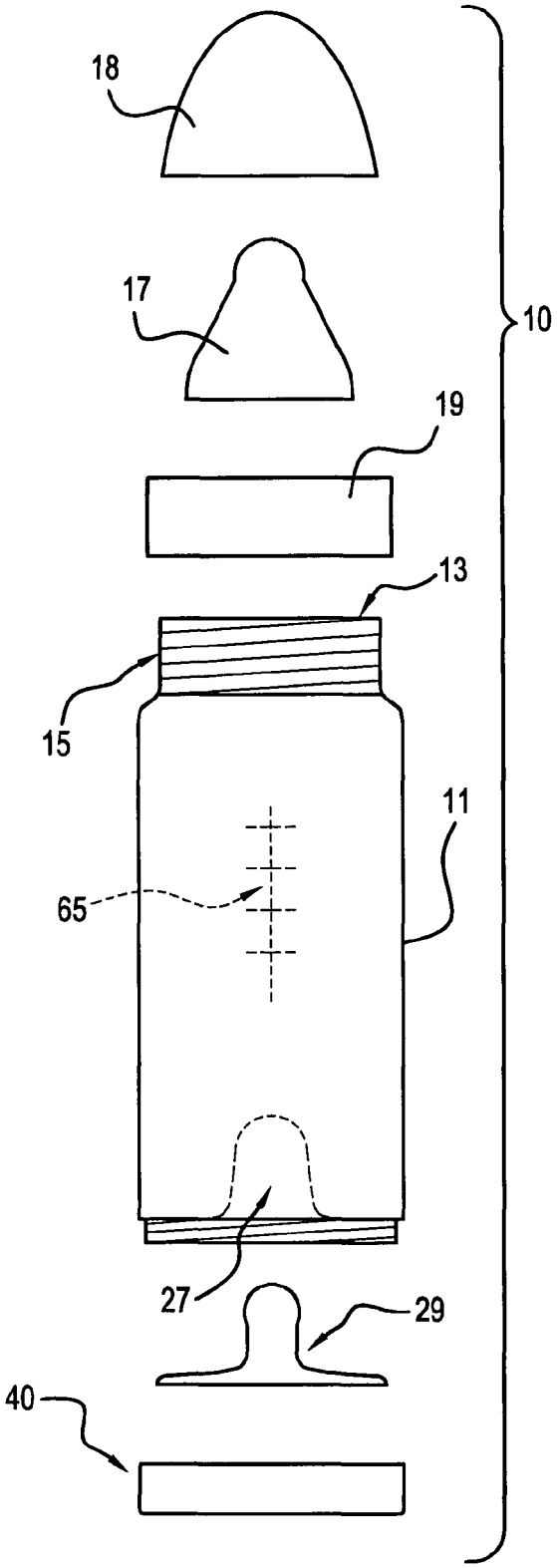
FIG. 1 shows a side exploded view of a first embodiment of the present invention.

Reference is first made to FIG. 1 which shows the main embodiment of the present invention generally designated by the reference numeral 10. This embodiment includes a bottle body 11 having an upper opening 13 and, just below the opening 13, an elongated area 15 that is threaded. The threaded area 15 is longer than the typical threaded area in baby bottles for the reason set forth hereinafter. The elongated threaded area is provided so that the inventive bottle 11 is compatible with a variety of baby bottle systems now sold in the marketplace. For example, a baby bottle sold by an organization known as "Dr. Brown" employs a cap having elongated threads that permit attachment of the Dr. Brown anti-bubbling device. Thus, the inventive bottle 11 is compatible with that system.

FIG. 1 also shows a nipple 17 that is attached to a custom rim 19 in a suitable manner known to those of ordinary skill in the art. The rim 19 is internally threaded compatible with the threads of the threaded area 15, so that the rim may be threaded thereover to attach the nipple 17 to the bottle 11. A removable cap 18 covers the nipple when not in use.

Figure 2:
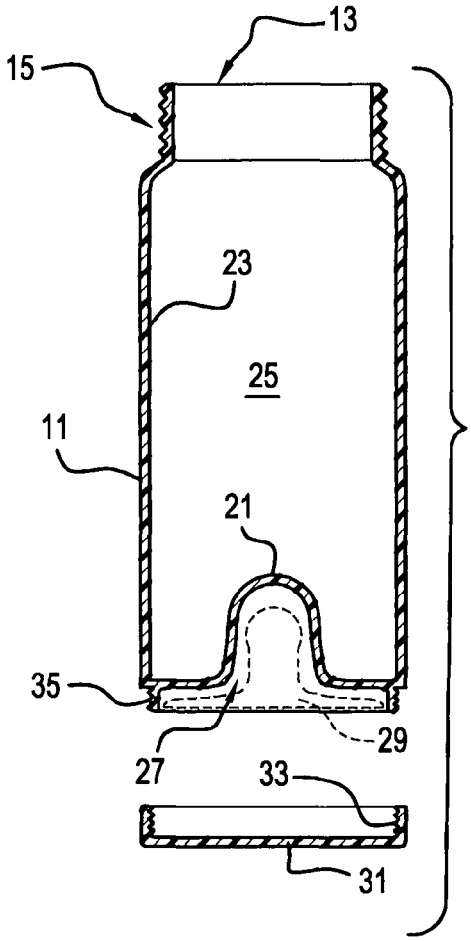
FIG. 2 shows a longitudinal cross-section showing portions of the embodiment of FIG. 1 along with an alternative cap 31 in place of the device 40 of FIG. 1.

With further reference to FIGS. 1 and 2, the lower end of the bottle 11 is closed by an undulating wall 21 that defines with internal walls 23 the internal chamber 25 of the bottle 11. The undulating wall 21 also defines a sub-chamber 27 at the bottom of the bottle 11 that is designed to receive, for storage, a pacifier 29 shown in phantom in FIG. 2.

With further reference to FIG. 2, the sub-chamber 27 may be enclosed by a removable cap 31. The removable cap has internal walls 33 that are threaded complementary to the threads 35 at the bottom of the bottle 11 as clearly shown in FIG. 2.

Figure 3:
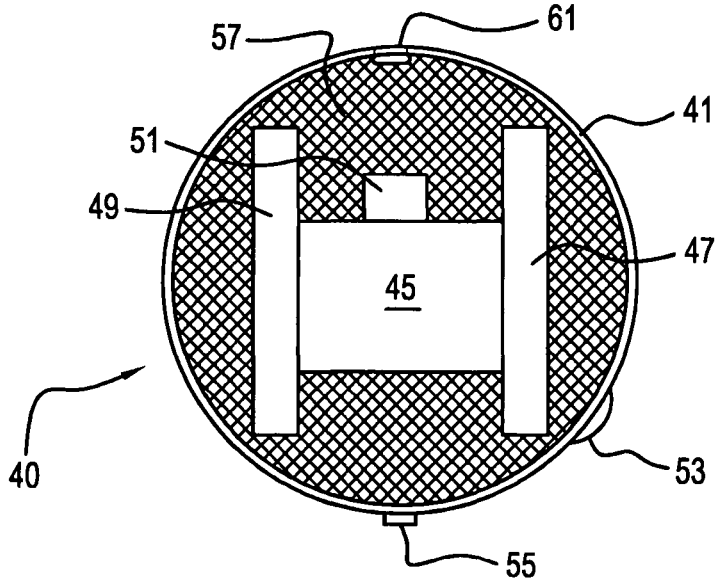
FIG. 3 shows a top view of a music playing and vibratory producing device in accordance with the teachings of the present invention.
Figure 4:
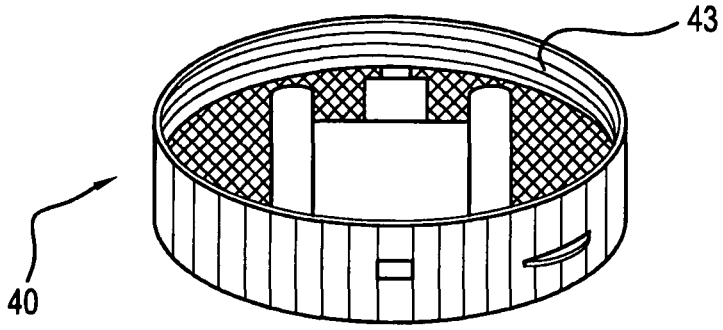
FIG. 4 shows a perspective view of the device of FIG. 3.
Figure 5:
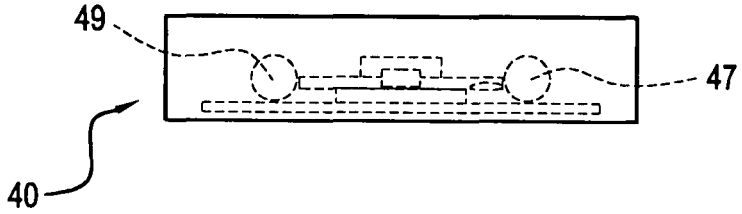
FIG. 5 shows a side view of the device of FIGS. 3 and 4.

Alternatively, instead of the cap 31, the device best seen in FIGS. 3-5 may be screwed over the threads 35. The device depicted in FIGS. 3-5 is generally designated by the reference numeral 40. With reference first to FIG. 3, it is seen that the device 40 includes a housing 41 having internal walls 43 that are threaded, as best seen in FIG. 4. The threads in the walls 43 are complementary to the threads 35 shown in FIG. 2 on the bottle 11 so that the device 40 may be screwed over the threads 35 to attach the device 40 onto the bottom of the bottle 11.

With reference back to FIG. 3, the device 40 includes a music playing unit 45 powered by batteries 47 and 49 (also seen in FIG. 5) as well as a massaging unit 51 which comprises a vibratory device. A volume control 53 controls the volume of music or other program material played by the music playing device 45. A four-way switch 55 allows the device 40 to be de-activated or, alternatively, to play music from the device 45, providing massaging effect through vibrations of the device 51 or simultaneously playing music as well as providing the massaging feature. The device 40 also includes a speaker 57 that allows sound to emanate from the bottom of the device through openings formed therein as understood by those skilled in the art.

In an important aspect, the inventive device 40 includes a USB port 61 enabling the device 40 to be connected to a source of programming. For example, music that is desired to be played by the device 45 may be downloaded into a memory section of the device 45 for later playback via the USB port 61. Alternatively, other programming may be similarly downloaded such as the voice of the mother of the infant using the bottle 11 in which the voice speaks soothing words that may be replayed over and over again so that the infant is placated and relaxed.

Concerning the massaging unit 51, this may be a vibratory device whose vibrations are transmitted through the housing 41 via the threaded wall 43 and the threaded area 35 of the bottle 11 to the infant via the nipple 17. In the preferred embodiment, the massaging unit 51 is programmable so that the vibrations thereof may be adjusted as to frequency as well as amplitude. Additionally, the unit 51 may be pre-programmed so that it may be activated, deactivated, and re-activated, etc., for pre-set periods of time.

In a further aspect, with reference back to FIG. 1, a heat sensor and display 65 may be provided on the bottle 11. This device may take the form of a chemical device that changes colors responsive to different temperature levels being achieved or, alternatively, may comprise a digital or analog temperature gauge, the display of which is easily seen on the side of the bottle 11 so that the person providing an infant with baby formula will know the temperature of the formula without having to squeeze a quantity of formula through the nipple 17 to test it. If desired, the heat sensor and display may be incorporated into the rim 19.

Figure 6:
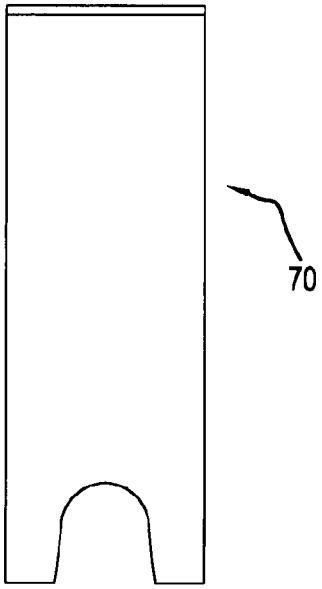
FIG. 6 shows a liner usable in accordance with the teachings of the present invention.
Figure 7:
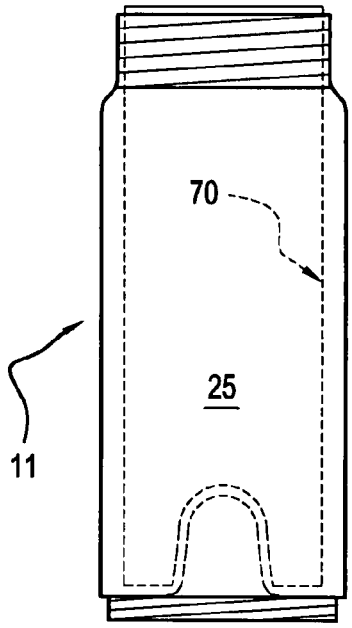
FIG. 7 shows the inventive bottle with such a liner installed therein.

With reference to FIGS. 6 and 7, a liner 70 may be employed in the present invention and may be inserted into the chamber 25 of the bottle 11 to ensure sterility. Liners such as the liner 7 are commonly sold in the marketplace, for example, by PLAYTEX.

Figure 8:
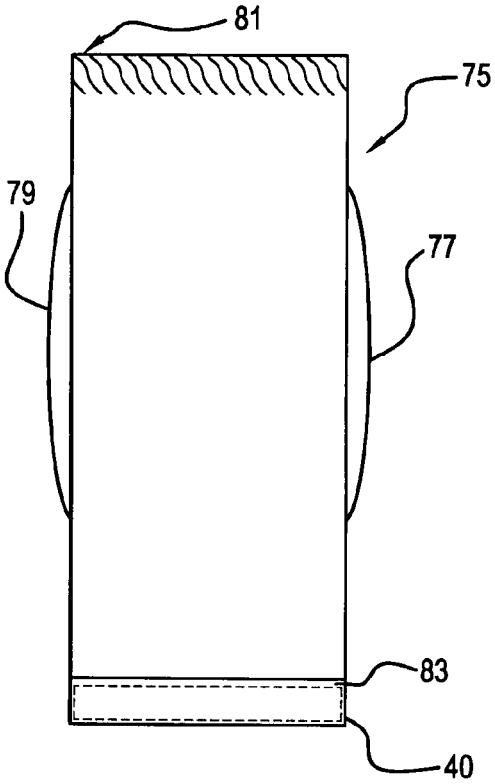
FIG. 8 shows a sleeve in accordance with the teachings of the present invention including a pocket for the music and vibratory device.
Figure 9:
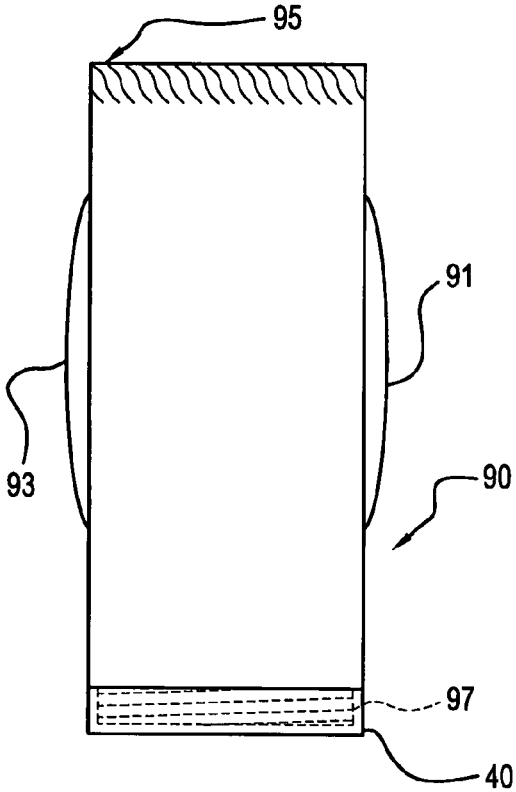
FIG. 9 shows an alternative version of the sleeve in which no pocket is provided, but an appropriate coupling is provided to permit the music and vibratory device to be releasably attached thereto.

With reference to FIGS. 8 and 9, a sleeve may be provided to be stretched over the outer walls of the bottle 11 for insulative effect. With reference first to FIG. 8, such a device is designated by the reference numeral 75 and is made of a suitable elastic fabric. Handles 77 and 79 are provided to facilitate easy gripping. The upper end 81 is open so that the sleeve 75 may be stretched over the outer walls of the bottle 11. In the embodiment of FIG. 8, a pocket 83 is provided at the bottom of the sleeve 75 in which may be inserted a device such as the device 40. In an alternative construction illustrated with reference to FIG. 9, a sleeve 90 is made of an elastic fabric and includes handles 91 and 93. The upper opening 95 permits the device to be stretched over a bottle 11 in the same manner as is the case with the sleeve 75. At the bottom of the sleeve, a solid threaded wall 97 is attached with the threads having the same size and configuration as the threads 35 illustrated in FIG. 2, so that the threaded wall 43 of the device 40 (FIG. 4) may be used to screw the device over the threaded walls 97 to attach the device 40 thereto.

As explained above, the present invention in its various embodiments, provides a great degree of versatility for parents of infants who desire to use a baby bottle to feed their children while at the same time having a bottle that will sooth and entertain an infant and maintain the infant in a calm behavioral mode As such, an invention has been disclosed in terms of preferred embodiments thereof which fulfill each and every one of the objects of the invention as set forth hereinabove, and provide a new and useful modular baby bottle system of great novelty and utility.

Of course, various changes, modifications and alterations in the teachings of the present invention may be contemplated by those of ordinary skill in the art without departing from the intended spirit and scope thereof.

As such, it is intended that the present invention only be limited by the terms of the appended claims.

The invention claimed is:

1. A modular baby bottle system, comprising:

a) a bottle having an upper opening leading to a first internal chamber receiving a liquid, below said upper opening said bottle having an outer threaded surface;

b) a nipple attachable over said opening by a fastening ring with internal threads meshing with said threaded surface of said bottle;

c) said bottle having a lower opening leading to a second internal chamber, said first and second chambers being separated by an undulating wall;

d) a pacifier removably stored in said second internal chamber and a cover releasably attached over said lower opening, said undulating wall causing said second chamber to closely receive said pacifier therein;

e) further wherein said cover includes an integrally attached program playing device including a port enabling programs including music programs to be downloaded into a memory thereof for later play.

2. The modular baby bottle system of claim 1, wherein said cover has internal threads enmeshing with external threads above said lower opening to releasably attach said cover to said bottle.

3. The modular baby bottle system of claim 1, wherein said programs include a recording of a person's voice.

4. The modular baby bottle system of claim 1, wherein said cover includes a vibration producing device.

5. The modular baby bottle system of claim 1, further including a sleeve removably inserted into said upper chamber.

6. A modular baby bottle system, comprising:

a) a bottle having an upper opening leading to a first internal chamber receiving a liquid, below said upper opening said bottle having an outer threaded surface;

b) a nipple attachable over said opening by a fastening ring with internal threads meshing with said threaded surface of said bottle;

c) said bottle having a lower opening leading to a second internal chamber, said first and second chambers being separated by an undulating wall;

d) a pacifier removably stored in said second internal chamber and a cover releasably attached over said lower opening, said undulating wall causing said second chamber to closely receive said pacifier therein, said cover having internal threads enmeshing with external threads above said lower opening to releasably attach said cover to said bottle, said cover including, attached thereto, a program playing device including a port enabling programs to be downloaded into a memory thereof for later play, said cover further including a vibration production device that may be selectively adjusted as to frequency, amplitude, and period of vibrations, and e) a heat sensor and display on said bottle.

7. The modular baby bottle system of claim 6, wherein said programs include music or a recording of a person's voice.

* * * * *